US009857155B2

(12) United States Patent
Boatright

(10) Patent No.: US 9,857,155 B2
(45) Date of Patent: Jan. 2, 2018

(54) RIFLE BULLET

(71) Applicant: James Allen Boatright, Gassville, AR (US)

(72) Inventor: James Allen Boatright, Gassville, AR (US)

(73) Assignee: James Allen Boatright, Gassville, AR (US)

( * ) Notice: Subject to any disclaimer, the term of this patent is extended or adjusted under 35 U.S.C. 154(b) by 0 days.

(21) Appl. No.: 14/867,941

(22) Filed: Sep. 28, 2015

(65) Prior Publication Data

US 2017/0089677 A1 Mar. 30, 2017

(51) Int. Cl.
*F42B 12/02* (2006.01)
*F42B 14/02* (2006.01)

(52) U.S. Cl.
CPC ..... *F42B 12/02* (2013.01); *F42B 14/02* (2013.01)

(58) Field of Classification Search
CPC ..... F42B 14/00; F42B 14/02; F42B 30/02; F42B 12/02
USPC ..... 102/524
See application file for complete search history.

(56) References Cited

U.S. PATENT DOCUMENTS 3,952,657 A * 4/1976 Kaltmann ..... F42B 5/105 102/376
4,782,758 A * 11/1988 Washburn ..... F42B 5/045 102/430
7,455,015 B2 * 11/2008 Krstic ..... F42B 12/74 102/439
2003/0167954 A1 * 9/2003 Baumgartner ..... F42B 12/34 102/510

FOREIGN PATENT DOCUMENTS

EP 0 073 453 * 3/1983

* cited by examiner

*Primary Examiner* — Stephen M Johnson
(74) *Attorney, Agent, or Firm* — Mark Murphy Henry

(57) ABSTRACT

The present specification discloses a new self-aligning rifle bullet. The resulting bullet offers greatly improved rifle accuracy and reduction in aerodynamic drag for better long range shooting. The resulting improvements will help shooters achieve longer ranges, higher scores, smaller group sizes, and higher probabilities of first shot hits.

6 Claims, 6 Drawing Sheets

121
123
117
121
123
117

RIFLE BULLET

CROSS REFERENCES

None.

GOVERNMENTAL RIGHTS

None.

BACKGROUND OF THE INVENTION

The present disclosure is for a self-aligning rifle bullet offering better accuracy and aerodynamic performance. Increasing the long-range accuracy of rifle bullets is a subject well represented in the prior art. Much of the prior art is directed to adjustments in the rifle. Other prior art proposes changes to the bullet. Following is a brief discussion of accuracy problems that still remain unresolved by current or prior art solutions.

The French Army adopted the first aerodynamically designed long-range rifle bullet known as the "Balle D" bullet in 1898 for an 8×50 mmR Lebel smokeless powder service cartridge. The Balle D bullet was a lighter weight, spire pointed, boat-tailed rifle bullet made of a monolithic brass alloy. It could fly faster and farther than the earlier round nosed, heavy for caliber, cupro nickel jacketed, lead cored bullets it replaced. By 1906, every major army had adopted the version of this more aerodynamic bullet. These were the first generation tangent ogive bullets, and they have been the accepted norm for best accuracy in rifle shooting at all ranges. In fact, the majority of current standard issue target rifles use a 1.5-degree throat angle originally optimized for firing these tangent ogive bullets.

In the mid 1980's, ballistician William C. Davis developed a secant ogive boat-tailed Very Low Drag (VLD) bullet design. The purpose of the invention was to serve as a more efficient long-range target rifle bullet. Many of the current accurate long-range rifle bullets are characterized as this second generation jacketed and lead cored VLD bullets. However, with current VLD bullets, riflemen have discovered two major problems—each stemming from what is known as in-bore yaw.

In-bore yaw occurs during firing when long nosed, short bodied, secant ogive bullets become canted at an angle to the bore of the rifle upon engraving of the bullet by the bore rifling. Once this happens, the bullet becomes off balance. Current VLD bullets are not designed to correct themselves during the remainder of their trip through the barrel and therefore the resulting trajectory of the bullet is altered. The impairment in the trajectory causes variability in target impact points. Moreover, the in-bore yaw causes the center of gravity (CG) of these VLD bullets to shift laterally off the bore axis and fly with rather large initial coning angles. These problems degrade the long-range accuracy of the bullet and result in an increased atmospheric drag and crosswind sensitivity than what is intended by the original design.

In response to the in-bore yaw and static imbalance problems associated with these jacketed, lead-cored VLD bullets, many long rang target shooters have chosen to select redesigned barrels. The purpose of the redesigning the rifling of the rifle barrel is to provide the slowest possible barrel twist rates. This is done in an effort to marginally stabilize their VLD match bullets. Unfortunately, one side effect of a lower barrel twist rate is a decrease in the gyroscopic stability (Sg) of the fired bullets. This tradeoff results in instability of the fired bullets at long ranges.

Recognizing the shortcomings of selecting barrels having slower twist rates, other shooters have opted to make adaptations to the bullet design. One popular design is known as the Berger Hybrid Ogive bullet design. This Berger Hybrid Ogive bullet design is a variant of a VLD design utilizing a modified head shape. The ogive-generating curve of a bullet is the calculated curvature of the nose of the bullet. In this context, the base portion of the ogive of Berger hybrid bullet is a type of tangent ogive, while the remainder of the hybrid ogive is a shortened secant ogive design ending in a rather large diameter (0.15 caliber) blunt meplat. Although somewhat effective at managing the VLD accuracy problem, much of the aerodynamic advantage of using a secant ogive versus a tangent ogive nose shape has been traded away in this dual ogive design, i.e., the Berger Hybrid design only improves the VLD style bullet guidance problem at the front end of its dual ogive, while the rear portion of the bullet is still free to shift around within the necessary case neck and ball seat clearances.

Current solutions do not completely satisfy the VLD accuracy problem, but instead result in a give and take—gaining accuracy in some areas while losing aerodynamic efficiency in others. The present invention provides a much better solution. The present invention reduces or eliminates in bore yaw, thereby allowing shooters to select faster barrel twist rates and achieve greater accuracy at longer ranges, while also solving the shifting problem inherent to the Berger Hybrid Ogive bullet design.

BRIEF SUMMARY OF THE INVENTION

The present specification discloses a new type of self-aligning, ultra low drag rifle bullet that solves the shortcomings of the prior art. It offers both greatly improved rifle accuracy and an average 15 percent further reduction in aerodynamic drag for better long range shooting.

This new self-aligning bullet utilizes a meplat, a secant ogive design, a foreshank, a conical ramp, a rear driving band, a boat tail, and a rear cavity—all calculated to achieve greater accuracy. Most importantly, the resulting bullet is designed to be self-aligning in the rifle barrel. This alignment is independent of the design of the chamber and throat in the rifle firing it. These and other advantages will become apparent from the following detailed description which, when viewed in light of the accompanying drawings, disclose the embodiments of the invention.

BRIEF DESCRIPTION OF THE DRAWINGS

FIG. 6 is a longitudinal cross section of the first preferred embodiment of the bullet

LISTING OF COMPONENTS

101—Meplat

103—Secant Ogive Nose

Figure 1:
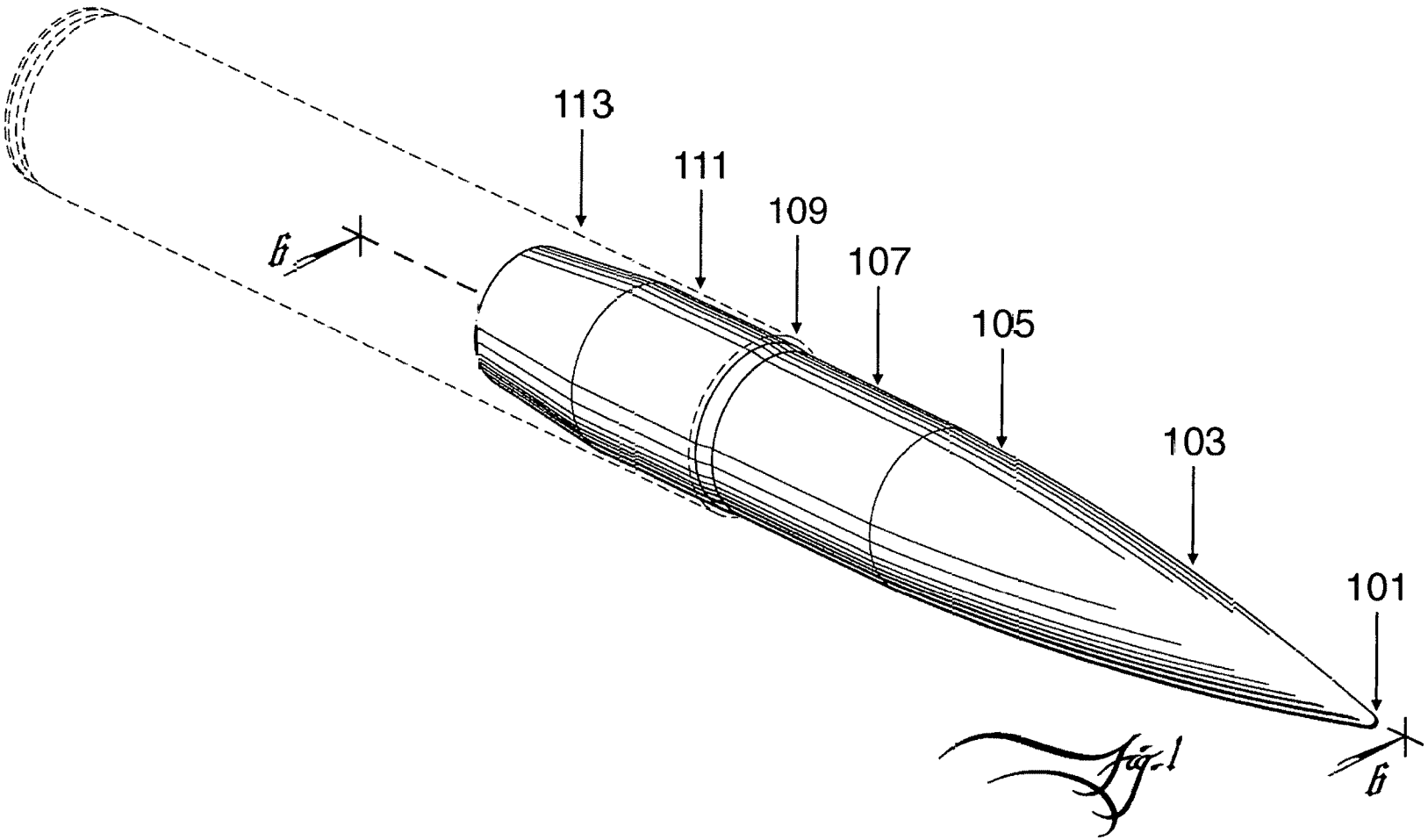
FIG. 1 is a perspective view of the bullet
Figure 2:
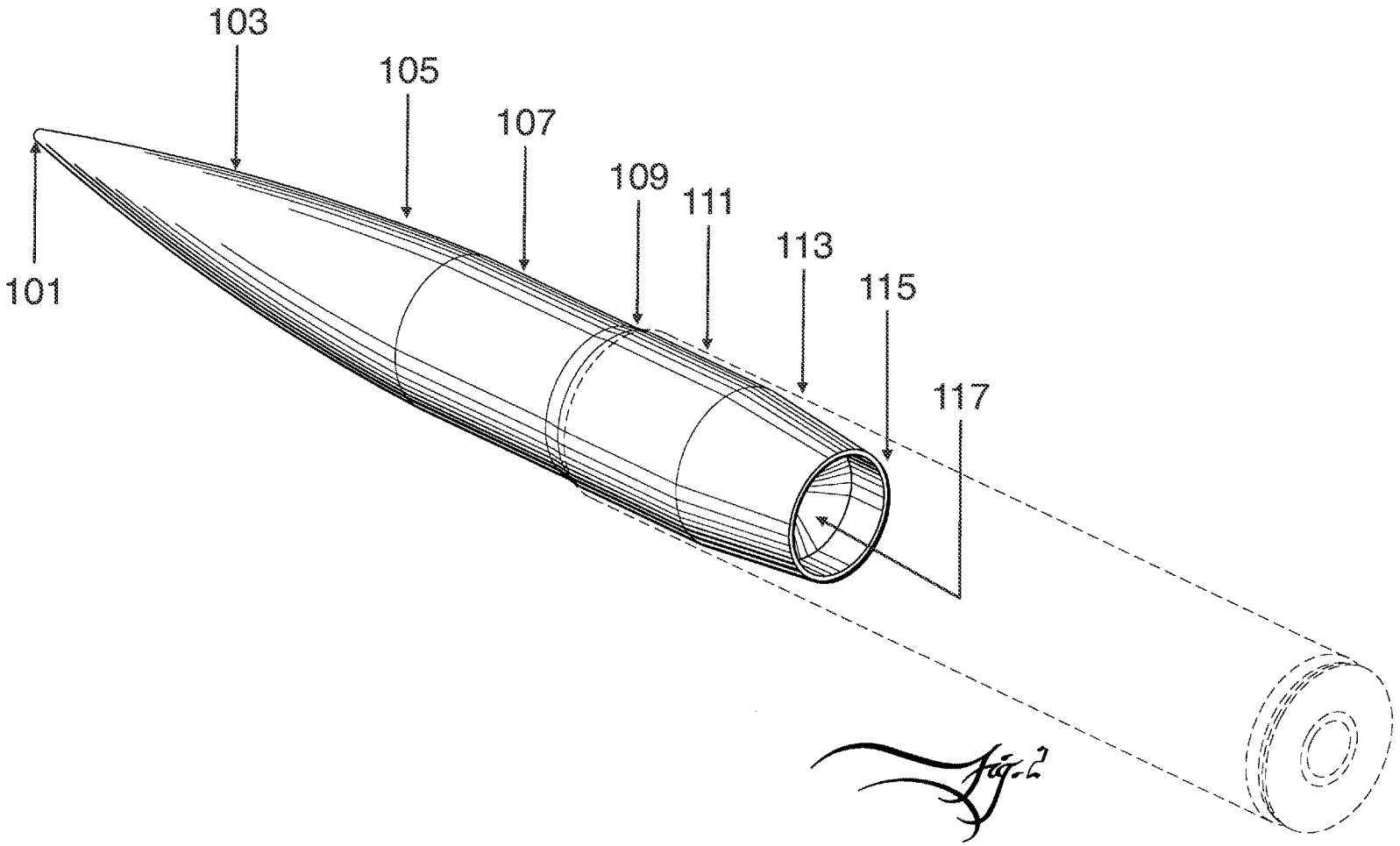
FIG. 2 is a perspective view of the bullet
Figure 3:
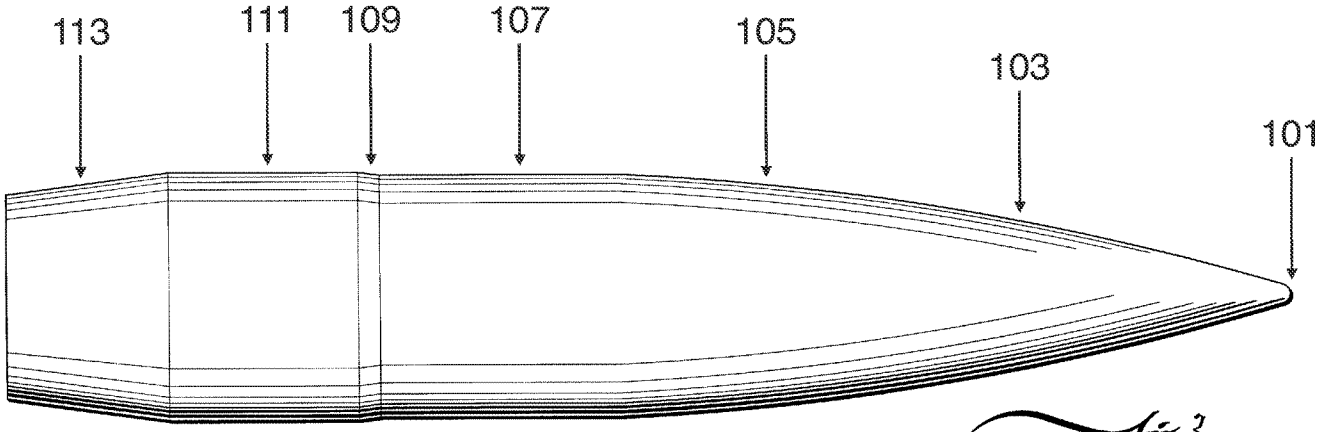
FIG. 3 is a side view of the bullet
Figure 5:
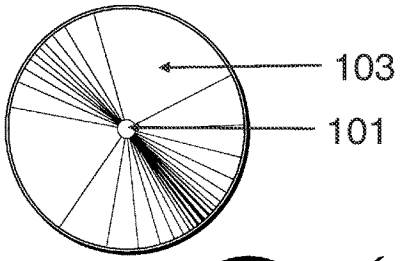
FIG. 5 is a front view of the bullet
Figure 4:
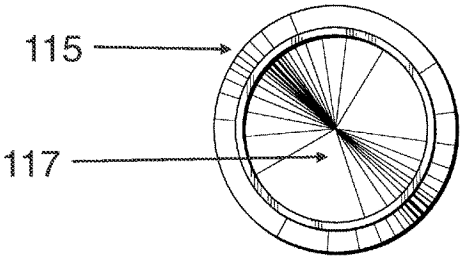
FIG. 4 is a rear view of the bullet
Figure 4:
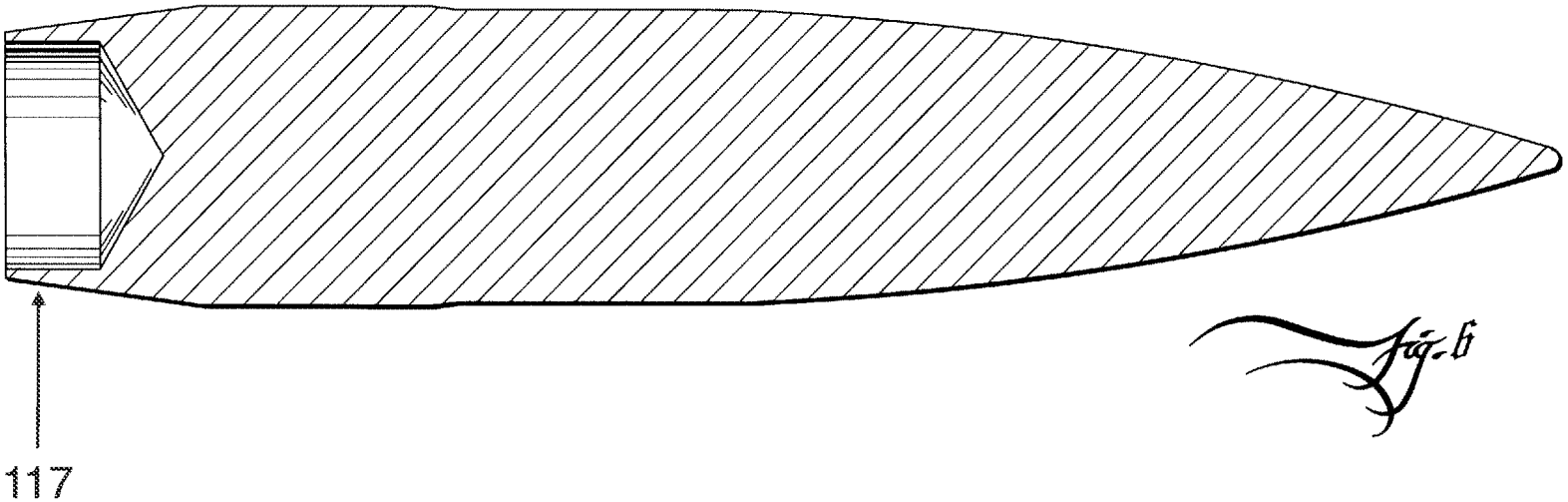
Figures 7, 8:
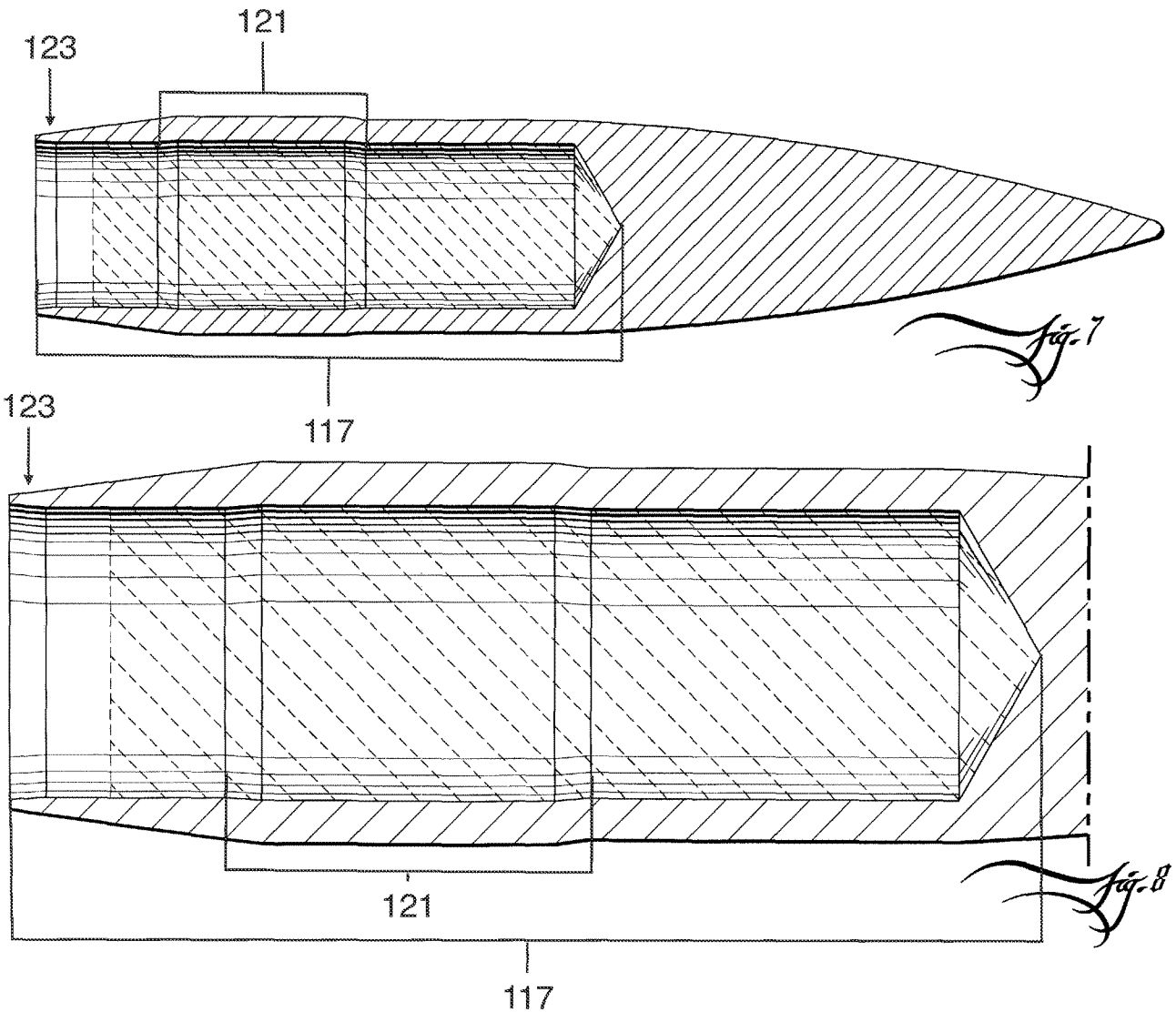
FIG. 7 is a longitudinal cross section of the second preferred embodiment of the bullet.
FIG. 8 is a detailed view of the longitudinal cross section of the second preferred embodiment of the bullet.
Figure 9:
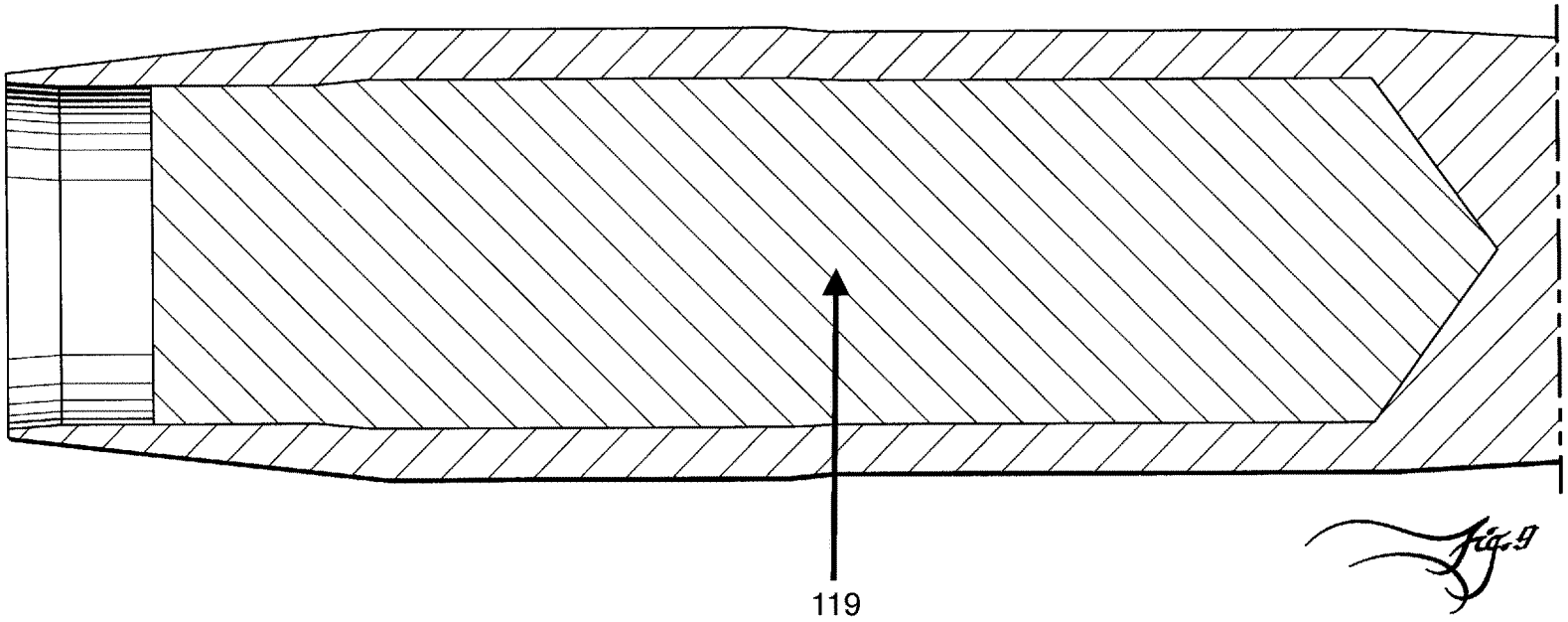
FIG. 9 is an internal view showing the core material of the bullet.

105—Ogive Base
107—Foreshank
109—Conical Ramp
111—Rear-Driving Band
113—Boat Tail
115—Base
117—Rear Base Cavity
119—Core Material
121—Internal Relief Groove
123—Tapered Ramp

DETAILED DESCRIPTION OF THE INVENTION

The basic bullet shape in this first preferred embodiment includes a meplat 101, a secant ogive nose 103, an ogive base 105, a foreshank 107, a conical ramp 109, a rear-driving band 111, a boat tail 113, a base 115, and a rear base cavity 117.

In the first preferred embodiment, the self-aligning bullet is made from rod stock of machining brass alloy in an automated computerized numerical control (CNC) turning center in any of the various calibers currently favored for long range rifle shooting. Except for minor variations to accommodate caliber specific bore and groove diameter standards, the first preferred embodiment of the self-aligning bullet invention will have an outside profile and shape that is generally scalable by caliber size.

For purposes of calculating and replicating a standard design of the self-aligning bullet invention, the bore diameter of the rifle barrel is assigned a 1.0 caliber reference diameter point. This approach differs from the usual rifle bullet design practice of using the nominal groove diameter of standard rifle barrels. For purposes of establishing relative dimensions disclosed herein the overall length of the complete bullet is understood to be approximately 5.5 reference diameters.

Beginning with the tip of the bullet, as shown on FIG. 1, there is a meplat 101. In this preferred embodiment, the meplat 101 is very small when compared to other prior art bullet designs. The meplat 101 is tangent to the secant arc at approximately the 0.09*11 reference diameter point.

The meplat 101 is the tip of the secant ogive nose 103. In this preferred embodiment, the secant ogive nose 103 is approximately 2.9-3.1 reference diameters in length. The length of secant ogive nose 103 is longer than other standard VLD bullet designs. Its approximate 18.5 reference diameters radius of curvature of the secant ogive-generating curve is twice the radius of curvature (9.25 reference diameters) of a similar 3.0 reference diameter tangent ogive bullet design. These dimensions, e.g., having a secant ogive with twice the generating radius of a tangent ogive for that same nose length, are understood to be almost the lowest drag nose shape possible.

As part of the overall secant ogive nose 103 there is also an ogive base 105. In this preferred embodiment, the outside diameter of the ogive base 105 is preferentially calculated using the bore diameter of the rifle barrel (rather than using the traditional method of using groove diameter). The ogive base 105 has an approximate outside diameter equal to the bore diameter of the rifle barrel (+) 0.0002 inches. Sizing the ogive base 105 in this manner creates an average of 5.5 percent reduction in cross-sectional area when compared to the prior art.

Adjacent to the ogive base 105 is a foreshank 107. The cylindrical foreshank 107 has a length of approximately 1.1-1.3 reference diameters. The foreshank 107 will mechanically center the front of the bullet inside the rifling lands. As the bullet enters the rifling during firing, the foreshank 107 provides the proximal guidance to keep the bullet concentric to the bore. The foreshank 107 and conical ramp 109 represent the self-aligning region of the bullet.

The conical ramp 109 has a proximal end connected to the foreshank 107 and a distal end connected to a rear driving band 111. The angle between these two points preferentially forms an approximate 7.0-8.0 degree incline towards the rear driving band 111. This conical ramp 109 is a caliber specific width averaging approximately 0.10 reference diameters for rifle bullets and joins the proximal end of the rear driving band approximately 1.2-1.4 reference diameters distal to the ogive base 105. The design of the conical ramp 109 centers the rear of the bullet and serves two important purposes. First, the proximal end of the conical ramp 109 increases the lug contact area, thereby minimizing the shearing of the brass driving band material as spin up torque is rapidly applied to the bullet during firing. Second, the approximate 7.0-8.0 degree angle serves to center the distal end of the bullet on the barrel axis as it enters the small cone angled throat of a target rifle. Thus the axis of the bullet if forcefully centered on the axis of the rifle barrel at two separate places.

In this first preferred embodiment, the rear driving band 111 is located distal to the conical ramp 109 yet proximal relative to the boat tail 113. The rear driving band 111 is designed to be wider and larger in diameter than in other prior art designs. The allows the bullet to be firmly seated into a self-contained rifle cartridge case, confers better obturation of the brass bullet in the rifle barrel, and allows the bullet to withstand the rigors of rifle interior ballistics. The caliber specific top widths of the rear driving band 111 vary from 0.54 reference diameters to 0.65 reference diameters, averaging 0.6 reference diameters. The outside diameter of the rear driving band 111 is a caliber-specific diameter, which varies from 1.020 reference diameters to 1.034 reference diameters.

Distal to the rear driving band 111 is a boat tail 113. In this preferred embodiment, the conical boat tail 113 is approximately 0.60-0.80 reference diameters in length and tapers at an approximate angle of 7.0-8.0 degrees to the base 115, which has an approximate diameter of diameter of 0.8-0.9 reference diameters. The proximal 0.10 reference diameter length of the boat tail 113 is engraved by the rifling lands during firing and, thus, also serves to widen the rear driving band 111 mechanically to an effective width of approximately 0.80 reference diameters.

As further refinement to this first preferred embodiment, the boat tail 113 is preferentially machined or hollowed to form a rear base cavity 117. This rear base cavity 117 has several functions. It shifts the center of gravity of the rifle bullets slightly forward as compared to bullets having no rear base cavity 117. This results in better in-flight stability and enlarges the effective volume of each cartridge's combustion chamber. In this preferred embodiment, the rear base cavity 117 should be drilled axially along the length of the bullet ranging from an approximate depth of 0.3 reference diameters to 0.5 reference diameters having an approximate 120-degree drill point angle in the rear region of the boat tail 113. The drill diameter for the bore cavity depends on the bullet caliber, but is selected to leave a thin, but substantial, ring of material, 0.008 to 0.016 inches in rim thickness at the base 115 of the boat tail 113.

A second preferred embodiment of this self-aligning bullet design contains those elements set forth in the first preferred embodiment with some additional refinements, now stated. In this second preferred embodiment, the self-aligning bullet has a rear base cavity 117 that is machined to allow for the insertion of a desired core material 119 to bring each bullet design instance to its preferred final weight and mass distribution. When machining the rear base cavity 117, various drill tip angles and reamer shapes are intended, depending upon the preferential amounts of brass to be removed, the relative density of additional core material 119 to be added in each specific design, and the ability to respond to bullet expansion under stress of firing. The base drill diameter is preferentially selected from drill diameters available. It is disclosed for the selected drill size to establish a preferred rim thickness (0.008-0.0016 inches) for each given bullet size or caliber. This second preferred embodiment may preferentially also have an internal relief groove 121 created within the region of the rear driving band 111. The internal relief groove 121 may, depending upon preference, have an internal diameter greater than the base drill diameter, thereby creating a preferred difference in depth of the rear base cavity 117. This may be a preferred depth of 0.0025 inches having potential tapers approximating 0.1 reference diameters in length leading into and out from the internal relief groove 121. A preferred taper may mimic the external 0.1 reference diameter tapers of the rear driving band 111. During firing, the internal relief groove 121 serves to compensate for any amount of brass material displaced as the barrel rifling forcibly engraves the rear driving band 111. Such displacement may also serve to mechanically enmesh the core material 119, thereby creating more stability within the bullet. To facilitate the insertion and concentric pressure seating of the core material 119, a tapered lead-in ramp 123 may be preferentially machined into the distal 0.1 reference diameter length of the rear base cavity 117. The mouth of the rear base cavity 117 may also be enlarged by 0.004 inches in internal diameter in this second preferred design embodiment.

This disclosure of the two preferred embodiments are not intended as a limitation on the scope of the invention but instead a detailed enabling description of the bullet design advances contemplated herein.

I claim:

1. A bullet comprising:
a proximal tip;
a meplat situated at the proximal tip;
a secant ogive nose distal to the meplat;
an ogive base;
a foreshank distal to the ogive base;
a conical ramp distal to the foreshank;
a rear driving band distal to the conical ramp, wherein the rear driving band defines an at least one internal relief groove;
a boat tail distal to the rear driving band, wherein the boat tail defines a rear base cavity;
a tapered ramp forming an entrance to the rear base cavity; and
a distal base.

2. The bullet of claim 1, wherein the bullet is constructed from a monolithic brass alloy.

3. A bullet comprising:
a proximal tip;
a meplat situated at the proximal tip;
a secant ogive nose distal to the proximal tip;
a foreshank distal to the secant ogive nose;
a conical ramp distal to the foreshank, wherein the conical ramp has an incline angle of 7.0-8.0 degrees;
a rear driving band distal to the conical ramp, wherein the rear driving band defines an at least one internal relief groove;
a boat tail distal to the rear driving band, wherein the boat defines a rear base cavity, and wherein the boat tail has an incline angle of 7.0-8.0 degrees;
a tapered ramp forming an entrance to the rear base cavity; and
a distal base.

4. The bullet of claim 3, wherein the bullet is constructed from a monolithic brass alloy.

5. A bullet comprising:
a proximal tip;
a meplat situated at the proximal tip;
a secant ogive nose distal to the proximal tip;
a foreshank distal to the secant ogive nose;
a conical ramp distal to the foreshank, wherein the conical ramp has an incline angle of 7.0-8.0 degrees;
a rear driving band distal to the conical ramp, wherein the rear driving band defines an at least one internal relief groove;
a boat tail distal to the rear driving band, wherein the boat tail defines a rear base cavity, and wherein the boat tail has an incline angle of 7.0-8.0 degrees and the rear base cavity defines a space for seating a core material;
a tapered ramp forming an entrance to the rear base cavity; and
a distal base.

6. The bullet of claim 5, wherein the core material is comprised of a lead or polymer material.

* * * * *